United States Patent [19]

Zell et al.

[11] Patent Number: 4,813,890

[45] Date of Patent: Mar. 21, 1989

[54] CENTERING MODULE FOR GUIDANCE AND ACCEPTANCE OF A CABLE PLUG WITH SHIELDING POSSIBILITY

[75] Inventors: Karl Zell, Niederpoecking; Peter Seidel, Groebenzell; Leo Pelzl, Holzkirchen, all of Fed. Rep. of Germany

[73] Assignee: Siemens Aktiengesellschaft, Berlin and Munich, Fed. Rep. of Germany

[21] Appl. No.: 85,368

[22] Filed: Aug. 14, 1987

[30] Foreign Application Priority Data

Sep. 25, 1986 [DE] Fed. Rep. of Germany ..... 3632599

[51] Int. Cl.[4] ..... H01R 13/648

[52] U.S. Cl. ..... 439/607

[58] Field of Search ..... 439/607–610, 439/92, 95, 96, 108

[56] References Cited

U.S. PATENT DOCUMENTS

| | | | |
|---|---|---|---|
| 4,381,129 | 4/1983 | Krenz | 439/607 |
| 4,386,814 | 6/1983 | Asick | 439/607 |
| 4,588,854 | 5/1986 | Bailey et al. | 439/567 |
| 4,601,527 | 7/1986 | Lemke | 439/608 |
| 4,655,518 | 4/1987 | Johnson et al. | 439/108 |
| 4,687,263 | 8/1987 | Cosmos et al. | 439/108 |

FOREIGN PATENT DOCUMENTS 2909627 9/1980 Fed. Rep. of Germany .

*Primary Examiner*—Neil Abrams

*Attorney, Agent, or Firm*—Hill, Van Santen, Steadman & Simpson

[57] ABSTRACT

A centering module member combined with a contact spring element, pre-mounted thereon by means of a simple plug-in connection that, when the centering module is fastened to a grounded shielding plate, the plate is directly contacted by the contact spring element. At the same time, the part of the contact spring element engaging through a corresponding recess into an interior space of the centering module member presses resiliently against a metallic housing of a plugged-in cable plug. The contact spring element forms a frame composed of webs, whereby spring tongues engaging into the interior space are attached to at least two webs lying opposite one another.

11 Claims, 2 Drawing Sheets

CENTERING MODULE FOR GUIDANCE AND ACCEPTANCE OF A CABLE PLUG WITH SHIELDING POSSIBILITY

BACKGROUND OF THE INVENTION

This invention relates generally to a centering module for guidance and acceptance of a cable plug and in particular to a cable plug having a metallic housing part connected to the shielding of an attached cable. A conductive connection from the metallic housing part to a grounded carrier occurs during the plug-in event.

It is known (German published application No. 29 09 627) to provide a centering strip of a plug mechanism with a metallic shroud which extends essentially perpendicular to the plug mechanism and has openings for the passage of plug contacts or terminal elements. This shroud is electrically connected to regions of a sub-rack lying at a grounded potential, and is connected thereto either directly or via fastening elements of the plug mechanisms. A self-sticking metal foil which is glued to the centering strip is used as the shroud.

For an apparatus for connecting the shielding of a plug of a multi-pole plug connector to the grounded potential layer of a sub-rack, wherein the plug partially engages passages of a centering strip during the plug-in event, it is known to apply a metallic, electrically conductive layer to the lateral faces of these passages. The shielding of the plug is provided with spring elements in such fashion that these press resiliently against the applied metallic layer when the plug engages the centering strip.

In order to obtain a low-impedance connection to a grounded potential layer of a centering strip serving for the acceptance of a plug on a motherboard, it is known to use a shielding element which presses roughly flush against the side walls of the centering strip. These shielding elements, separately provided for every long side of the centering strip, carry individual springs applied thereto as separate parts. In the plugged condition of a plug, these springs press resiliently against the shielding thereof. The planar shielding elements lying in the centering strip are electrically connected to regions of a sub-rack holding the motherboard which lie at grounded potential.

SUMMARY OF THE INVENTION

An object of the present invention is to provide a centering module in a structurally simple fashion such that the coupling resistance of the connection of a metallic plug housing of the plug with the grounded potential layer has an extremely low-impedance.

This is achieved in that the centering module member is combined with a resilient metal element in such an arrangement that the part situated at its wall contacts the metal element when the centering module is fastened in the edge area of a cut-out provided in a shielding plate. This shielding plate serves as a grounded carrier and has the necessary passage for the plug contacts or the cooperating contacts of the cable plug. The metal element establishes contact in at least one part of the contacting surface between the centering module and the shielding plate. A part of the metal element extends through at least one corresponding recess into the interior of the centering module and resiliently presses against the metallic housing of the plug-in cable plug.

As a result of the one-piece metal element, a conductance for the metallic housing of the plug is provided on a short, direct path to a grounded carrier, such as a shielding plate, without additional fitting space, particularly in the inside region of the module. At the same time, extremely beneficial large-area contacting is achieved. With respect to its position, the part of the metal element extending into the interior space of the centering module member is fixed such that the metallic housing of the plug provides the shielding of the centering module.

According to an advantageous improvement of the invention, the metal element is a three-dimensionally fashioned contact spring element whose part, situated against the outside wall of the centering module, is a frame fashioned all around of webs which embraces the lower edging of the centering module and whose part, extending into the interior space of the centering module, resides roughly perpendicular to the former part. At two webs lying opposite one another, the metal element is fashioned in the shape of at least one respective spring tongue having a forward-bent contact end region. A contact spring element fashioned in this way can be simply manufactured from an appropriate contact spring sheet. This allows for simple pre-assembly of the contact spring element on the centering module member. This materials-saving manufacture is particularly beneficial for a metal spring element with a plurality of spring tongues provided per web side. In the manufacture of the single-piece spring element, these individual tongues are manufactured as projectures which can be nested in one another, and which are then bent out of the frame following the appropriate pre-shaping of their respective end region.

A good contacting against the shielding plate is achieved when the web side attached to the spring tongues is crimped at a plurality of locations. The contacting to the shielding plate then occurs at these locations with the broad side of the appertaining webs, whereby a certain large-area seating is achieved. Basically, such spring tongues can be attached to all web sides forming the spring frame. When this is carried out for only two opposite webs, then the webs not provided with a spring tongue can reside roughly at a right angle relative to the former.

BRIEF DESCRIPTION OF THE DRAWINGS

The features of the present invention which are believed to be novel, are set forth with particularly in the appended claims. The invention, together with further objects and advantages, may best be understood by reference to the following description taken in conjunction with the accompanying drawings, in the several Figures in which like reference numerals identify like elements, and in which:

DESCRIPTION OF THE PREFERRED EMBODIMENT

Figure 4:
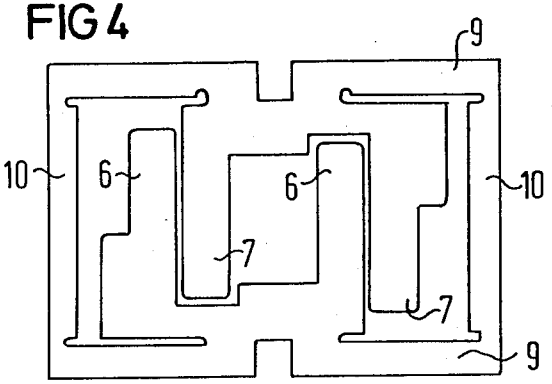
FIG. 4 is a plan view of the contact spring element.
Figure 5:
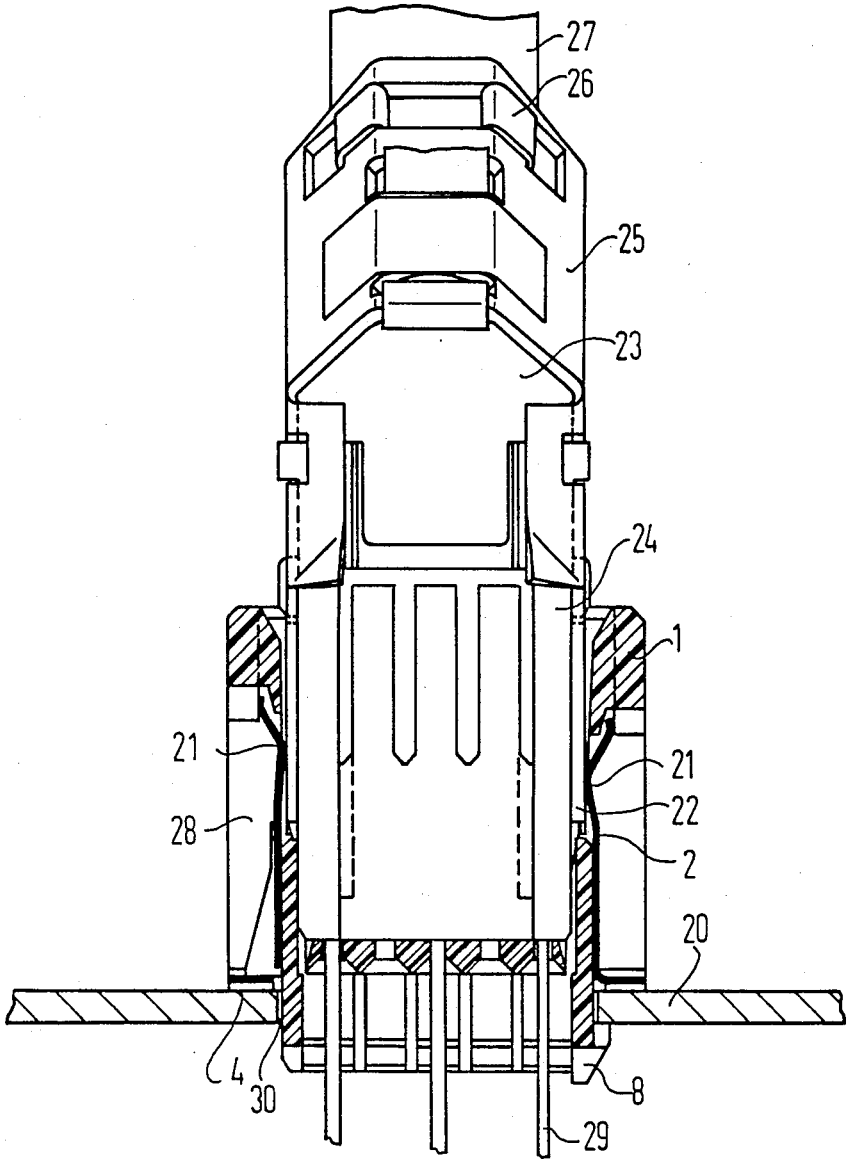
FIG. 5 is a sectional view as in FIG. 3 of the centering module having a plugged-in cable plug, whereby the centering module is attached to a shielding plate.

In the centering module shown in FIGS. 1 through 5, a centering module member 1 has a contact spring element 2 which is pre-mounted on the module member 1, as shown in FIG. 5. The module member 1 is secured to a shielding plate 20 via a recess 30, which s mated to the member 1 and secured thereto by simple pressing. This fastening results from a plurality of latch hooks 8 situated on at least two opposite sides of the module member 1. After the centering module 1 has been pressed on, the hooks 8 engage the plate 20, so that a snap-in connection results with good retention between plate 20 and centering module 1. These latch hooks 8 are attached to the centering module member 1 as elastic parts and, have a bevelled end in order to facilitate the plug-in operation into the recess provided on the shielding plate 20. When producing this snap-in connection via the latch hooks 8, the centering module 1 must be properly positioned. This is assured by at least one centering arbor 11 attached to the outside wall of the centering module member 1 which engages a corresponding recess at the cut-out edge.

The contact spring element 2 whose plan view is shown in FIG. 4 can be simply manufactured in a materials-saving fashion by having tongues 6 and 7 cut into one another. The spring element 2 is manufactured from a contact spring sheet. The contact spring element 2 is fashioned according to FIG. 4 such that a frame is established by the webs 9 and 10 at the broad and at the narrow side. In the exemplary embodiment, one tongue pair 6, 7 is attached at two webs 9 lying opposite one another. Dependent on the size of the centering module, additionals spring tongues can also be provided. Every spring tongue 6, 7 is pre-shaped, such as by a crimp in its respective end region facing away from the appertaining web, and can extend through a cut-out 15 of the spring module member 1 allocated to every spring tongue. Other than the shaping of the upper end region of the contact spring tongues 6, which may be seen in FIG. 3, the tongues 6 are bent in the same direction at approximately a right angle relative to the surface of the appertaining web 9. For an alternating offset of the spring tongues 6 lying adjacently opposite one another in the web frame, they then project out of the frame formed by the webs 9 and 10. In the centering strip member, such spring tongues can be attached to the individual webs in an arbitrary combination. This is also true for each of the webs forming the frame.

In order to achieve a good contacting of the contact spring element 2 after engaging the shielding plate 20, the webs 9 are crimped at locations 4. In the exemplary embodiment, this crimping is done only for the longitudinal webs 9 which carry the spring tongues 6, 7. Such pre-shaped contact locations, however, could also be provided for every other web. In the exemplary embodiment with the right-angled execution of the centering module 1, the webs 10 at the narrow sides are bent at a right angle in the same direction in comparison to the webs 9 of the longitudinal side. Such contact tongues 6, 7 are formed only for the two longitudinal webs 9.

The pre-fabricated contact spring element 2 which is shaped in the above-described way is slipped onto the side of the centering module 1 which lies opposite its unilaterally right-angled opening. The angled-off webs 10 thereby connect approximately flush against the side wall of the centering module member 1 within a recess mated to the width of the spring sheet. In the pressed-on condition of the contact spring element 2, the longitudinal webs 9 are seated against the surface 3. The existing contact tongue 6, 7 lie at every wall side of the module, lying in a depression 28 corresponding to the width of the web, and have their upper pre-shaped region extending into the interior space of the centering module member 1 through a passage 15. The bent area of every spring tongues 6, 7 extending into the interior forms the contact location to the shroud of the plug when the plug is plugged in. In this embodiment, the contact spring element 2 has spring tongues 6, 7 offset at every longitudinal web 9 in comparison to the longitudinal web 9 lying opposite. The depressions 28 and passages 15 at the side wall of the module 1 are provided at the locations corresponding to these spring tongues 6, 7. At least that spring tongue of each and every longitudinal wall side lying closest to the side wall has a corresponding graduation of locations or nubs 5 raised point-like at its upper edge. When the contact spring element 2 is united with the centering module member 1, these nubs 5 are inserted into a corresponding slot provided in the centering module member 1. The slot height is selected to provide a tight fit. Such a location 5 can also be provided in the connecting part of the two spring tongues of a wall side. When the contact spring element 2 is inserted, it is likewise inserted tightly in the slot under the projection 19. The attached contact spring element 2 is held on the shielding plate 20 by the nubs 5 and the mated slots until final assembly. The through openings 13 for the cooperating contact elements may be seen in FIGS. 2 and 4. These through openings 13 are fashioned having inwardly slanting walls as a respective guide aid for the cooperating contacts. The side wall of the module member 1 extending downwardly beyond this bottom plate 17 carries ribs 14 for extending the tracking distance and for guiding the contact pins into the through opening 13.

Figure 3:
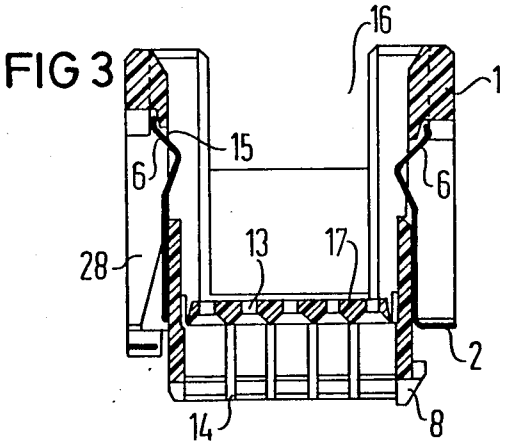
FIG. 3 is a sectional view, whereby the section is placed perpendicularly relative to the side view shown in FIG. 1 such that a respective spring tongue engaging opposite wall faces is depicted.
Figure 2:
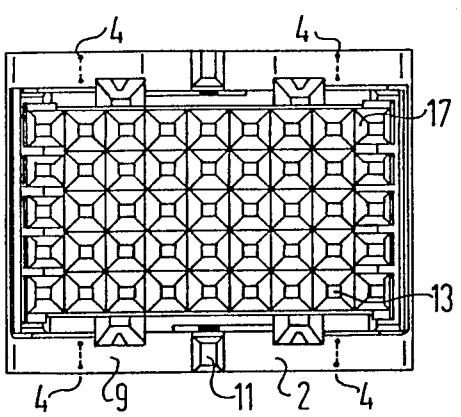
FIG. 2 is a plan view of the underside of the centering module.
Figure 1:
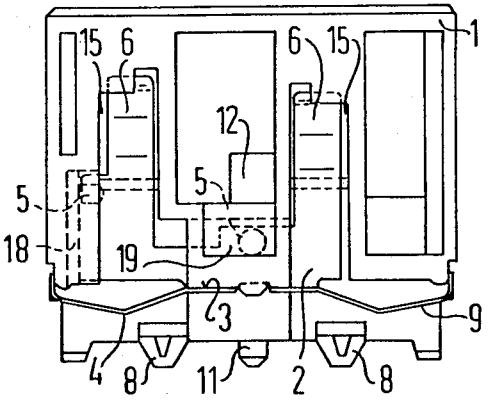
FIG. 1 is a side view of the centering module.

FIG. 5 shows the centering module 1 attached to a shielding plate 20 by the snap-in connection in the same type of section view as in FIG. 3. A cable plug 23 is plugged into the centering module 1. The new shielding concept is disclosed in this this connection. For example, this cable plug 23 is plugged onto the free ends of the contact blades 29. Such contact blades 29 can be arranged at a wiring backplane of a subrack. A shielding plate 20 which is connected to grounded potential can then serve as a terminating plate. A passage in this shielding plate 20 having the dimensions of the centering module 1 is provided at the locations at which the passage for the contact blades 29 is necessary.

As already mentioned, the centering module 1 is anchored to the shielding plate 20 with the assistance of latch hooks 8 which provide a snap-in connection. The strain relief for the cable 27 connected to the plug is provided by the metal band 26. In the exemplary embodiment, the cable plug 23 is essentially composed of the combination of a metal housing 25 with the spring clip member 24. The spring elements are accommodated in this spring clip member 24 in coincident arrangement with the through openings of the bottom plate 17 of the centering module 1. These spring elements, for example, are connected to the individual leads of the cable 27 via solder lugs. The metallic housing 25 can, for example, be fashioned as a resilient metal part, so that the two parts are held by spring contact pressure and are locked by special latch noses. At least in the passage region of the spring tongues 6, 7 of the contact spring element 2, the metallic housing 25 has projections which extend into the centering module 1. After the plugging event, the spring tongues 6, 7 then press resiliently against these metallic projections. A good contact location to the metallic plug housing 25 via a leg 22 results at the bend point 21 of the springs. At the same time, the bend location 4 on the web at the long side which has its broad side proceeding parallel to the shielding plate 20 is pressed against this plate with the snap-in connection between the centering module 1 and the shielding plate 20. The connections of the shroud to the shielding plate 20 provides a short, direct path and in large-area fashion by the onepiece contact spring element integrated in the centering module.

The invention is not limited to the particular details of the apparatus depicted and other modifications and applications are contemplated. Certain other changes may be made in the above described apparatus without departing from the true spirit and scope of the invention herein involved. It is intended, therefore, that the subject matter in the above depiction shall be interpreted as illustrative and not in a limiting sense.

What is claimed is:

1. A centering module for guidance and acceptance of a cable plug, said module composed of a centering module member and a one piece contact spring element, said spring element having a frame part formed by surrounding webs and a second part residing approximately perpendicularly thereto and fashioned in the form of spring tongues, said second part extending at least in part into an interior space of the centering module member, and whereby, upon fastening the centering module member to a shielding plate, the frame part contacts the shielding plate in a lateral region of a cut-out in the plate for the passage of the cable plug, and whereby a conductive connection exists between the spring tongues and a metallic housing of the cable plug after the plug-in event, after being located in the centering module member, pressing only against outer walls of the centering module member such that the frame part formed by the surrounding webs encloses a bottom edge of the centering module member; a lower region of the spring tongues being located in a corresponding depression in the centering module member; and the spring tongues being fashioned such that an upper contact region of the spring tongues extends into the interior space of the centering module member so that the contact spring element is joined with the centering module member.

2. The centering module according to claim 1, wherein each of the spring tongues located approximately perpendicularly relative to the frame part has at least one dimple-shaped location; this dimple-shaped location being tightly contained in a corresponding mated slot in the centering module member, when inserting the contact spring element into the centering module member.

3. The centering module according to claim 2, wherein said spring tongues are provided and are offset relative to one another in an alternating pattern from opposed webs of said frame part and wherein the spring tongues have their upper contact region extending through corresponding recesses in the centering module member into the interior space of the centering module member.

4. The centering module according to claim 3, wherein the at least one dimple-shaped location is provided at least at every outwardly situated spring tongue of each side at its outermost edge; and wherein each of the spring tongues also has an incision at its outside so that this dimple-shaped location is tightly held in a corresponding slot of a respective side wall part of the centering module member, when inserting the contact spring element into the centering module member.

5. The centering module according to claim 3, wherein an upwardly open cut-out is provided in wall surfaces of the centering module member lying opposite one another and not provided with recesses for the acceptance of said spring tongues, a guide rib on a spring clip member of the metallic housing pressing against a lateral cut-out limiting surface of said cut-out when the cable plug is plugged in.

6. The centering module according to claim 3, wherein at least one side wall of the centering module member, through which said spring tongues extends into said interior space, has a cut-out in which a centering nose on the metallic housing is engaged when the cable plug is plugged in.

7. The centering module according to claim 3, wherein the centering module member has elastic latch hooks for fastening the centering module to said shielding plate, which engage the underside of said shielding plate at the appertaining limiting lines of a cut-out provided in said shielding plate.

8. The centering module according to claim 1, wherein a projection defining the position of said shielding plate is provided on the centering module member, said projection engaging a cut-out in said shielding plate corresponding therewith when the centering module is coupled to said shielding plate.

9. The centering module according to claim 1, wherein said depressions allowing said spring tongues to extend into said interior space are provided at wall surfaces of the centering module member which lie opposite one another.

10. The centering module according to claim 1, wherein a web connected to the spring tongues is crimped at several locations; and wherein a broad side of the respective webs points in the direction of the shielding plate to be connected to the centering module, so that contacting occurs at these locations when the centering module is connected to the shielding plate.

11. The centering module according to claim 1, wherein a seating surface for at least two webs of said frame part is formed by a recess in the centering module member and at least sub-regions of said two webs lying opposite one another have their broad side located on the seating surface.

* * * * *